US005220980A

United States Patent [19]

Petter

[11] Patent Number: 5,220,980

[45] Date of Patent: Jun. 22, 1993

[54] GUARD FOR OPERATOR OF PALLETIZED LOADS

[75] Inventor: Jay C. Petter, Pentwater, Mich.

[73] Assignee: Pentwater Wire Products, Inc., Pentwater, Mich.

[21] Appl. No.: 709,595

[22] Filed: Jun. 3, 1991

[51] Int. Cl.[5] ..... B66B 9/20

[52] U.S. Cl. ..... 187/9 R; 414/785

[58] Field of Search ..... 187/9 R, 9 E; 414/785, 414/608

[56] References Cited

U.S. PATENT DOCUMENTS 2,564,002 8/1951 Gibson ..... 414/785
2,814,402 11/1957 Schaefer ..... 414/785
3,283,933 11/1966 Vander Wal ..... 414/785
4,904,147 2/1990 Wasylyshyn ..... 414/785

*Primary Examiner*—Robert P. Olszewski
*Assistant Examiner*—Kenneth Noland
*Attorney, Agent, or Firm*—Price, Heneveld, Cooper, DeWitt & Litton

[57] ABSTRACT

An L-shaped screen is provided designed to remain with a pallet during both placement in and removal from storage and also while the pallet and its load are in storage, one leg of which is secured to a pallet for transport with the pallet and the other leg extends vertically from the one leg to serve as a barrier to intercept and hold the load on the pallet should it become unstable and prevent any of it from falling on the lift truck operator or on personnel in the adjacent aisle after the lift truck has withdrawn.

22 Claims, 3 Drawing Sheets

GUARD FOR OPERATOR OF PALLETIZED LOADS

BRIEF SUMMARY OF THE INVENTION

An accessory to be used in warehouses employing vertical stacking of palletized loads which loads are of a type which might become unstable and fall into the adjacent aisle or on the operator while storing or removing them from multi-tier rack storage or on others using the adjacent access aisle. An L-shaped screen is provided, one leg of which is secured to the load supporting pallet and the other leg is a vertical panel positioned between operator and the load to serve as a means of preventing any of the pallet's load falling in the direction of the operator or into the aisle after the pallet and load have been placed in storage.

BACKGROUND OF THE INVENTION

As use of palletized warehousing expands and the cost of land for and of the building of warehouse facilities increases, the trend has been to use higher and higher storage racks. This conserves floor space. However, it increases the risk of injury to personnel should the articles stored on the pallets for any reason become unstable and fall. This can be the cause of serious, even fatal, injury. This problem can result from slow compression of the lower layers of goods stored on a pallet. This is particularly a risk of articles with low turnover and, therefore, subject to long-term storage. It can also result from small movements of the storage rack due to such causes as exterior traffic, adjacent construction activity or minor earth movements. As a result, the once vertically stacked load with uniform weight distribution becomes unbalanced and inclined to one side. Once this starts, the result can be progressive unbalancing and instability of the load. If this happens to be toward an aisle, the result could be serious to those in the aisle below, should some of the stored articles fall.

Another source of similar problems are pallets storing assorted articles loaded by personnel who are insufficiently trained or careless about arranging the articles on the pallet. Thus, heavy articles may be placed on top of lighter ones, less able to maintain their geometry when under such compressive loads. This type of article storage becomes particularly critical when storage racks become very tall to compensate for lack of adequate floor space. Today, it is not unusual to use racks substantially identical to those previously used but in warehouse facilities in which the pallets are stored in vertical tiers five or more pallets high. Thus, the articles on the upper pallets can fall a substantial distance and generate serious impact force.

BRIEF DESCRIPTION OF THE INVENTION

The invention provides an article engaging and retaining screen between the lift truck operator and the load, which screen is secured to the individual pallet and is designed to remain with the pallet during both transport and storage. The screen has a portion which underlies the pallet, is engaged by the fork or tines of the lift truck and is also anchored to the pallet so that it remains with the pallet after the pallet has been deposited by the lift truck both when the pallet is loaded and in storage and when the pallet is empty. The screen serves to prevent articles from falling toward the operator during transport and manipulation into and out of storage and also from falling into the aisle while the loaded pallet remains stored on the rack.

DESCRIPTION OF THE PREFERRED EMBODIMENT

Figure 1:
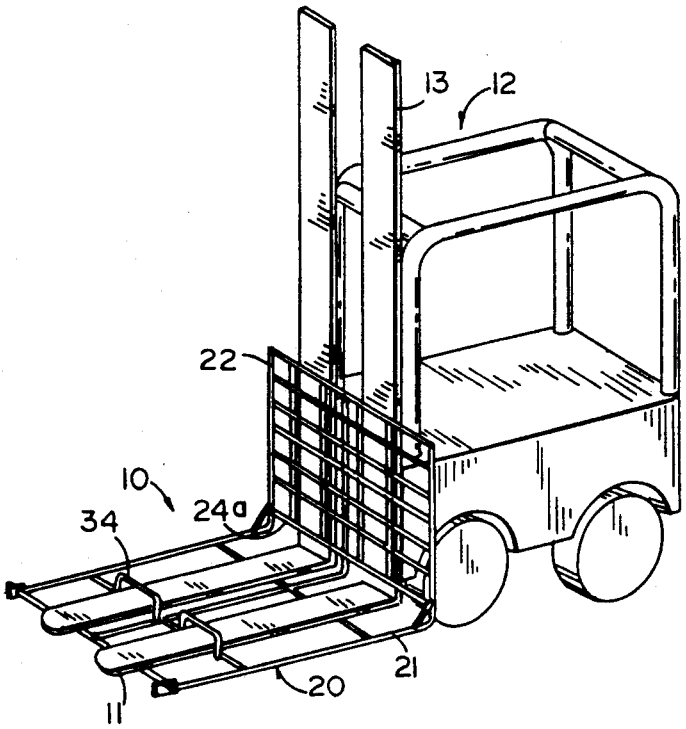
FIG. 1 is an oblique view of a typical warehouse lift truck equipped with the operator guard of this invention, illustrated without the pallet.

Referring to FIG. 1, a pallet guard 10 to which no pallet has been assembled is illustrated mounted on the forks 11 of a forklift truck 12. The forklift truck 12 and its forks are conventional.

In its most basic form, the guard 10 has an L-shaped primary frame 20 with a base portion 21 an integral therewith an upright or screen portion 22. The base and screen portions are rigidly joined to form an L-shaped unit with the upright screen portion 22 designed to be positioned adjacent the vertical track 13 of a forklift truck 12. The vertical track supports the fork assembly 11 for vertical travel during the transport, storage and removal of pallets in a warehouse. The fork assembly and its track are conventional in construction, and this invention is intended for use with any of the constructions.

Figure 2:
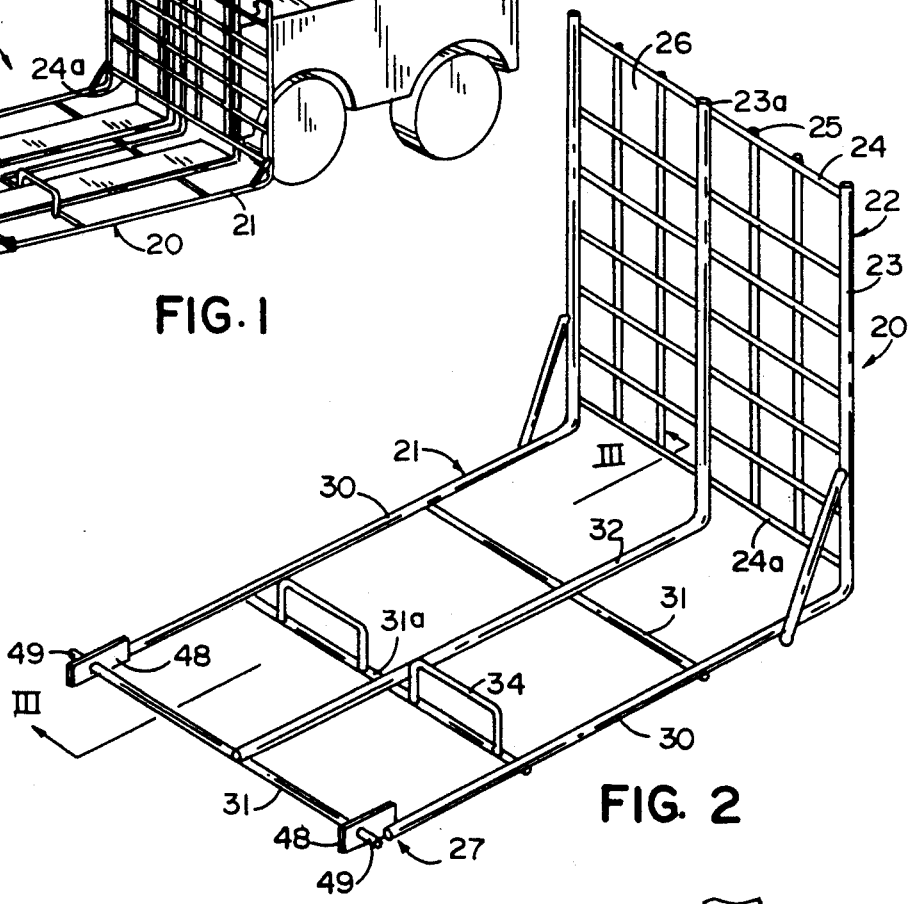
FIG. 2 is an enlarged oblique view of a basic pallet guard.

The screen portion of the frame has vertically extending side members 23 joined by cross members 24 which extend horizontally (FIG. 2). Between the side members 23, the screen has a number of spaced secondary vertical members 25. For strength and rigidity, the primary frame members and the cross members are welded together at their intersections.

The screen portion 22 has a height equal to or in excess of the height of the load expected to be stored on the pallet. This height is limited by the vertical spacing between the pallet supports of the warehouse's storage rack. It is also, in part, controlled by the characteristics of the material with which the pallets are loaded. It is important that its height be such that none of the load on the pallet is capable of passing over the top of the screen. It is also important that the screen be capable of supporting the thrust imposed by a load which has shifted against it for any reason. It is also important that it be capable of restraining further movement toward the screen of any of the individual packages or components of the load. For this reason, the screen has sufficient secondary vertical members 25 in addition to the primary vertical members 23 and 23*a*. These members in conjunction with the secondary vertical members are arranged in a grid pattern which will not permit any of the load to pass through the openings 26 in its grid. In most cases, a pattern with openings six to eight inches square will suffice, especially since no single cross or vertical member will have to serve as the sole article restraining member. Thus, a grid welded together of one-eighth diameter steel rod will be adequate. This, however, is exemplary. The actual dimensions will depend upon the nature of the load and the size of the screen.

Figure 4:
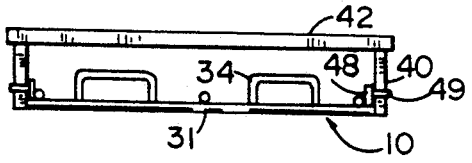
FIG. 4 is a front elevation view of the pallet guard illustrated in FIG. 2 when not engaged by a forklift and used with a pallet having no bottom boards or cross members.
Figure 5:
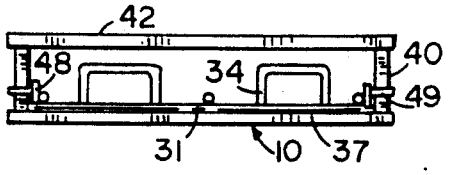
FIG. 5 is a view similar to FIG. 4 but with a pallet having both top and bottom boards.
Figure 10:
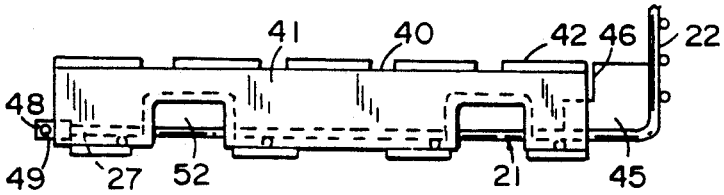
FIG. 10 is a fragmentary, side elevation view of a modified pallet construction for use with the pallet guard illustrated in FIGS. 7 and 8.
Figure 12:
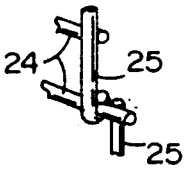
FIG. 12 is a fragmentary sectional view of one of the section hinges used in the pallet guard illustrated in FIG. 7.

The base portion 21 of the guard projects at a right angle to the guard's vertical portion 22 (FIG. 10). Its length is such that its free end 27 extends to or beyond the end of a pallet 40 opposite from the screen 22. Its width is such that it can be telescopically received between the legs or side members 41 of the pallet 40 (FIGS. 4 and 5). The sides 30 of the base portion 21 are connected by cross members 31 welded to them (FIG. 2). The cross members are also welded to the central member 32. The cross member 31*a* next to the cross member 31 at the free end of the base portion has a pair of upstanding tine brackets or loops 34 welded to it to receive the tines 11 of the forklift (FIG. 1). These loops together with the cross members to which they are secured form a four-sided rectangular opening each suitable to receive one of the forklift's tines therethrough.

Figure 3:
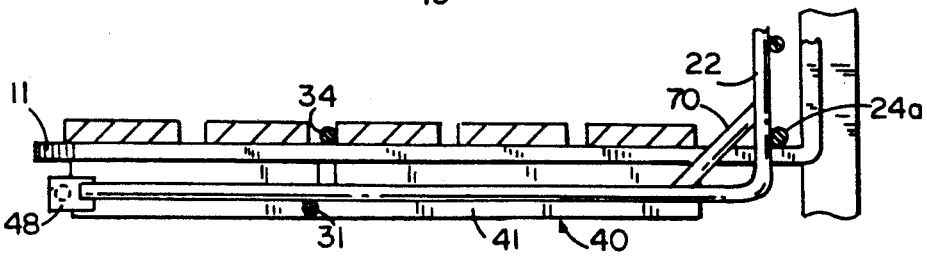
FIG. 3 is a fragmentary, sectional elevation view taken along the plane III—III of FIG. 2 illustrating the pallet guard with the pallet in an elevated position.

When the pallet guard 10 is used with pallet 40 having no bottom boards, and the pallet is idle and stored, the pallet guard 10 will rest on the floor as illustrated in FIG. 4. In this case, as the lifting action is initiated, the tines 11 of the fork will engage the brackets 34 which are shaped like rectangular wickets and thereby lift the screen independently of the pallet and its load. Preferably, the height of the wicket is such that shortly thereafter, the tines will engage the pallet. At the same time, the tines of the fork will engage beneath the bottom cross member 24*a* of the screen portion 22 (FIG. 3). Preferably, the brackets 34 as they are lifted will seat in one of the openings between the pallet's cross members 31, permitting the tines to engage the bottom surfaces of the cross members of the pallet. Since the diameter of the rod from which the tine brackets or loops are fabricated is less than the thickness of the cross members, the brackets will remain recessed in the opening as the pallet is lifted. It will be understood from this that the screen, during normal operation, does not bear any of the load of lifting or lowering of the pallet or its load during either transport or storage. The pallet operates only in the event of a malfunction which shifts the load on the pallet toward the operator. It is preferable from the standpoint of strength, that the loops or brackets be formed as U-shaped members which are welded to a cross member 31 at the bottom of the wicket opening, closing it. This arrangement provides structural reinforcement. It will be understood from this that, when a pallet equipped with a guard is picked up by a forklift truck, the tines of the forklift seat against the bottom surfaces of the pallet's top boards 42 of the pallet to lift the pallet and its load.

Figure 7:
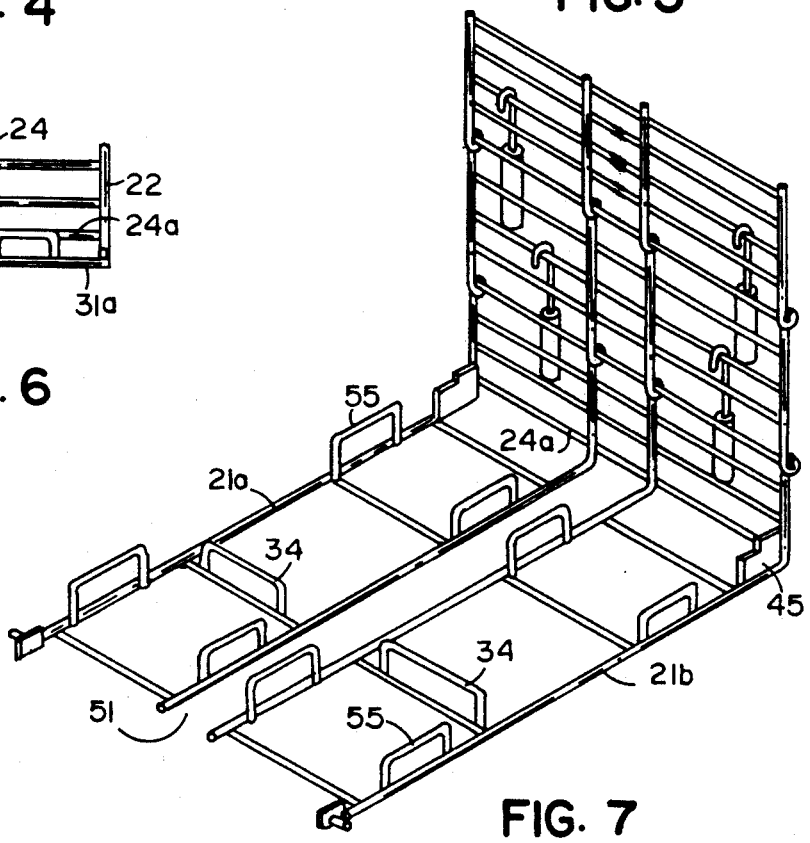
FIG. 7 is an oblique view of a modified construction for the guard without pallet.

It is desirable that the juncture between the base portion 21 and the guard or screen portion 20 be reinforced. Particularly is this important when the unit is called upon to perform its intended function, that is, prevent an unstable load from falling off the side of the pallet facing the forklift operator, or the aisle after the pallet has been placed in storage. This reinforcement can be accomplished by the use of the plates 45 welded to both the base and the screen (FIGS. 7 and 10). If the guard is constructed with the reinforcement plates 45 at the juncture between the base and screen portions, these plates can be shaped to seat beneath the adjacent top board of the pallet (FIG. 10). This can be done in the form of a notch 46, the vertical wall of which provides a stop acting against the edge of the pallet to limit the pallet's movement toward the vertical guard screen (FIG. 10). The plate 45 is welded to both the side members of both the screen and base portions and provides a high strength gusset to reinforce the corner, preventing possible failure of the pallet guard due to a displaced pallet load overstressing the juncture between the vertical and horizontal portions of the guard. An alternative for the plate is the diagonal brace 70 illustrated in FIG. 3.

The spacing between the end of the pallet and the screen 22 (FIG. 10) is desirable in many cases such as when the load on the pallet overhangs the edge of the pallet by an inch or two. Even if this situation does not exist, it is important that the screen portion of the guard have positive clearance from the articles on the pallet because, in the initial lifting and deposit of the loaded pallets, there is some, although limited, vertical movement of the guard 10 with respect to the pallet and its load as the tines or forks of the forklift move vertically into lifting engagement with or release of the palletized load. This arrangement does not interfere with the primary purpose of the plates 45 of serving as a high strength reinforcement to withstand the bending loads imposed on the juncture between the base and screen portions in the event of a load shift which displaces the load toward the forklift operator.

Most pallets have bottom boards or cross members 37 to provide strength and stability (FIG. 5). When used with this type of pallet, the base portion 21 of the pallet guard is inserted into the space between the top and bottom boards of the pallet.

Since the guards provided by this invention are designed, not only for protection of the forklift operator during stacking and removal, but also for protection of other personnel in the adjacent aisle during the entire period the loaded pallet is in storage, the guard remains with the pallet both when the loaded pallet is placed in storage and also while it remains in storage. To secure the guard to the pallet, a pair of anchor plates 48 are welded to the free ends of the base 21 (FIGS. 3, 4, 5 and 7). These are positioned to extend just beyond the ends of the legs 41 of the pallet. After the guard has been assembled to the pallet, stop pins 49 are secured to the anchor plates 48 to extend in front of the forward ends of the side members of the pallet and prevent the pallet from becoming separated from the guard. If the assembly is intended to be permanent, the pins 49 could be welded to the anchor plates 48. If the assembly is considered to be temporary, bolts could be used and secured to the anchor plates 48 by threads. The use of the anchor plates with the stop pins also assures the pallet remaining seated against or closely adjacent the reinforcement plates 45, stabilizing the pallet's position.

In the case of some types of products, the weight of the load on the pallet is such that the pallet has to have a central leg or beam 50 parallel to the legs or sides 30 to support the cross members 31. In this case, the base portion of the guard is divided into two sections 21*a* and 21*b* separated by a central slot 51 to accommodate the central beam (FIG. 7). Each of the sections has an upstanding loop or bracket 34 to engage a tine of the forklift.

Figure 6:
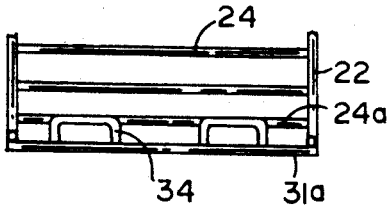
FIG. 6 is a fragmentary, front elevation view of a guard without a pallet.
Figure 9:
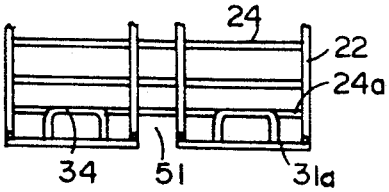
FIG. 9 is a fragmentary, front elevation view similar to FIG. 6 but illustrating the pallet guard of FIG. 7.

Irrespective of whether the pallet type requires use of the pallet guard 10 illustrated in FIG. 2 or the one illustrated in FIG. 7 to effect lifting of the pallet guard without excessive tilling toward the forklift, it is necessary to have tine engagement at substantially the same height both adjacent the screen portion 22 and the free end of the base portion 21. This can be accomplished by locating the bottom cross member 24*a* in the same horizontal plane as the top of the loops 34 (FIGS. 6 and 9). With this arrangement, the forklift tines will engage both members substantially simultaneously and thereby eliminate or effectively restrict fore and aft rocking of the pallet guard during its manipulation by the forklift. For this purpose, the cross member 24*a* may have to be reinforced either by use of a rod of larger diameter or other means.

Figure 8:
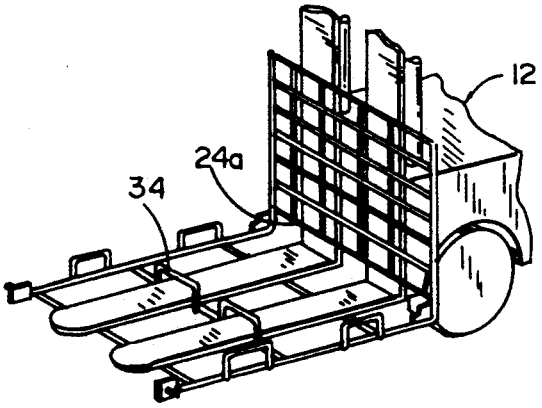
FIG. 8 is an oblique view similar to FIG. 1 illustrating a modified pallet guard engaged by a forklift.
Figure 11:
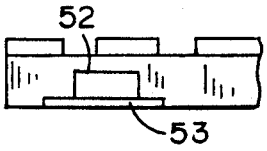
FIG. 11 is a fragmentary, side elevation view of a modified construction for the pallet illustrated in FIG. 10.

The invention can be adapted to accommodate those situations which require the pallets to be moved at a right angle to the direction they are normally moved for the purpose of transport and vertical stacking. This situation does not arise during stacking, unstacking or storage. Therefore, the necessity for the guard is either not involved or is at best quite minor since, in transport mode only, the pallets are normally elevated only enough to clear the floor. Such an arrangement is illustrated in FIGS. 7, 8 and 10. In this case, the pallets may be provided with openings 52 notched into the lower edges of the pallet leg 41 to accommodate the tines of a forklift truck approaching from the side. To avoid excessive weakening of the beams, these notches should be relatively shallow, preferably just high enough to permit the tines 14 to be inserted if the forklift is maneuvered with care. It is also possible to reinforce the pallet legs by bridging the bottom of the openings with a reinforcement strap 53 as suggested in FIG. 11. To provide lift for the guard 10*a*, appropriate loops 55 are provided to receive the tines from the side. While it would be possible to provide a second guard screen along the side of the pallet between its load and the forklift operator during sideway movement, this is not considered necessary, as has been pointed out.

Figure 13:
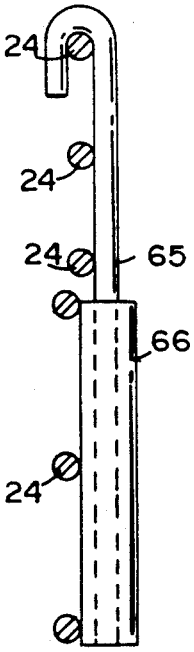
FIG. 13 is a fragmentary, sectional elevation view of a latch for a foldable screen.
Figure 14:
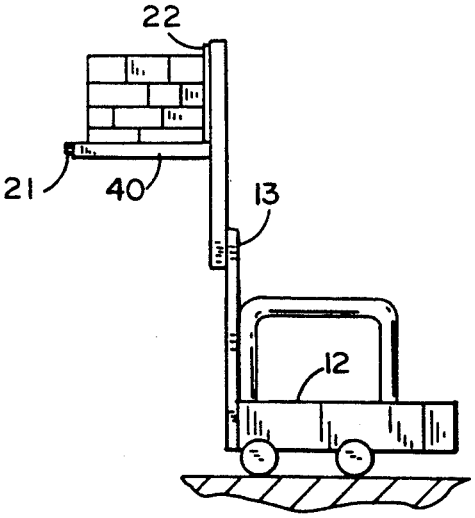
FIG. 14 is a side elevation view of a loaded pallet raised to storage height.

During periods when the pallet is not in use and may be placed in storage, it may be convenient to reduce the height of the screen 22. This can be done by dividing the screen into a base section 22*a* and one or more upper sections 22*b* (FIG. 7). These, when erected, are latched together by pins 65 one end of which are telescopically received in tubular member 66 welded to the cross members of the screen section below (FIGS. 7 and 13). To fold such a screen, the pins 65 are lifted to withdraw them from the members 66 and the screen section 22*a* folded downwardly. During this maneuver, the pins can be rotated so that the rod engaging hoops can move past the cross member 24 above. With this arrangement, the section can also be totally disconnected and placed in separate storage.

It will be understood from the preceding description that the invention provides a simple and relatively inexpensive solution to the safety hazards in warehouses using tiered storage of palletized loads. While a preferred embodiment of the invention has been described together with several modifications thereof, it will be recognized that other modifications can be made without departing from the principles of the invention. Such modifications are to be considered as included in the hereinafter appended claims unless these claims, by their language, state otherwise.

I claim:

1. A guard for the operator of a vehicle used to transport and stack on a rack in vertical columns pallets each having a load thereon, said vehicle having pallet engaging tines, said guard comprising: a frame having a base portion and an upright screen portion integral with each other to form an L-shaped member, said pallet having a load support surface and a pair of dependent legs, one adjacent each side of the pallet, said base portion of said frame being of a width to be seated between and closely adjacent said pallet legs, means on said base portion of said frame through which the tines of the vehicles can pass as the tines are moved into position for lifting said frame and the pallet with said screen portion always remaining between the operator and the load on the pallet for shielding the operator from the load should the load become displaced.

2. A personnel guard for use with vertically arranged palletized loads as described in claim 1, wherein said means are upstanding inverted U-shaped members adapted to receive the tines therethrough.

3. A personnel guard for use with vertically arranged palletized loads as described in claim 1 wherein said frame at the juncture between said base and screen portions has on each side an upstanding plate secured to base portion, said plate having means to engage the end of a pallet and hold it from contacting said screen portion.

4. A personnel guard for use with vertically arranged palletized loads as described in claim 3 wherein said means is a recess in said plate for receiving the edge of the adjacent load supporting surface of a pallet and holding it against further movement toward said screen portion.

5. A personnel guard for use with vertically arranged palletized loads as described in claim 3 wherein said plate is rigidly secured to both said base and screen portions to reinforce the juncture between said portions.

6. A personnel guard for use with vertically arranged palletized loads as described in claim 1 wherein stop means are secured to the free ends of said base portion and extend laterally therefrom to engage the legs of a pallet and prevent separation of said guard from the pallet lengthwise of said pallet legs.

7. A personnel guard for use with vertically arranged palletized loads as described in claim 1 wherein means are provided at the juncture of and welded to both said base and screen portions to reinforce said juncture and prevent angular displacement of said portions with respect to each other due to pressure exerted against said screen portion by the load on the pallet.

8. A guard for personnel adjacent pallets loaded with articles which pallets are placed in and removed from storage by a forklift vehicle having tines and while in storage are arranged in vertical columns and supported on racks, said guard comprising: an L-shaped frame having a generally horizontal base portion and a generally vertical screen portion, said pallet having a load support surface and a pair of dependent legs, one on each side extending lengthwise of the pallet, the width of said base portion of said frame being substantially equal to the spacing between said legs whereby it can be telescopically received between said legs, means at the free ends of said legs extending laterally outwardly therefrom to engage the adjacent ends of said legs for holding said base portion from being withdrawn lengthwise thereof from between said legs, the spacing between said legs being such that the tines of a forklift vehicle can be received between them for lifting said pallet, said base portion having spaced means adjacent each end for engagement by said tines for lifting said frame with the pallet.

9. A personnel guard for use with vertically arranged palletized loads as described in claim 8 wherein the height of said screen portion is at least the height of the load of articles on said pallet whereby none of the articles can pass over the top of said screen portion.

10. A personnel guard for use with vertically arranged palletized loads as described in claim 9 wherein said screen has both vertical and horizontal elements arranged in a pattern having openings through which the load on the pallet can be observed, said openings being of a size and shape such that the smallest article on the pallet cannot pass through them.

11. A personnel guard for use with vertically arranged palletized loads as described in claim 8 wherein said base portion is formed of two sections separated by a central opening extending the length of said base portion to accommodate pallets having a third leg midway between and parallel to said pair of dependent legs each of said sections having one of said tine engaging means.

12. A personnel guard for use with vertically stacked palletized loads as described in claim 8 wherein said pallet also has laterally extending bottom elements forming the space between said dependent legs into a rectangular tubular area open at each end, said base portion of said frame being telescopically received into said tubular area for moving the pallet horizontally or vertically.

13. A personnel guard for use with vertically stacked palletized loads as described in claim 12 wherein said tine engaging means are upstanding inverted U-shaped members each forming an opening therethrough of a height and width to permit one of said tines to pass through it, the spacing between said members being the same as that between said tines.

14. A personnel guard for use with vertically stacked palletized loads as described in claim 13 wherein the height of said openings is less than the spacing between the oppositely facing surfaces of said upper and lower elements.

15. A personnel guard for use with vertically stacked palletized loads as described in claim 8 wherein both said screen and base portions of said frame have parallel side members extending lengthwise thereof, the side members of said base portion each having upwardly offset U-shaped members so spaced as to receive the tines of the forklift therethrough whereby said frame and pallet can be lifted by a forklift truck positioned at a right angle to said screen.

16. A personnel guard for use with vertically stacked palletized loads as described in claim 15 wherein said legs of the pallet each have a pair of recesses therein opening through the bottom edge thereof and aligned with the offsets in said side member of said frame.

17. A guard for personnel adjacent pallets loaded with articles which loaded pallets while in storage are arranged in vertical columns on racks, said guard comprising: an L-shaped frame having a pallet receiving base portion and a vertically extending screen portion integral with said base portion and adapted to be positioned adjacent one vertical face of the load on the pallet, said screen portion being comprised of at least two panels joined by hinge means which panels at said hinge means can be folded into adjacent parallel relationship for storage, latch means for locking said panels together when aligned in a common plane.

18. A guard for personnel adjacent pallets loaded with articles which loaded pallets while in storage are arranged in vertical columns on racks described in claim 17 wherein said latch means are pins slidably mounted on one panel for vertical movement and tubular sockets mounted on the other panel into which said pin can be inserted when the panels are vertically aligned.

19. A guard for the operator of a vehicle having load engaging tines and used to transport and stack on a rack in vertical columns pallets each having a load thereon, said guard comprising: an L-shaped frame having a base portion and an upstanding screen portion integral therewith, said base portion being of a width to seat telescopically between and closely adjacent the legs of the pallet, means at the free end of said base portion extending in front of said legs for preventing disengagement by telescopic movement of said guard from the pallet, said base portion having means adapted to be engaged by the tines of the vehicle for supporting the guard and moving it vertically when the pallet is moved vertically.

20. A guard for the operator of a vehicle used with vertically arranged palletized loads as described in claim 19 wherein said pallets have surface forming members connecting said legs at both the top and bottom of said legs forming a rectangular passage therebetween, said base portion extending through said passage.

21. A guard for the operator of a vehicle having load elevating tines used to transport and stack on a rack in vertical column pallets each having a load thereon, said guard comprising: a frame having a base portion and an upright screen portion integral with each other to form an L-shaped member, said pallet having a load support surface and a pair of dependent legs, one adjacent each side of the pallet, said base portion of said frame being of a width to be seated between and closely adjacent said pallet legs, upstanding inverted U-shaped means on said base portion of said frame adapted to be engaged by said tines of said vehicle for lifting said frame and its screen portion independently but substantially simultaneously with said pallet to an elevated position with said screen remaining at all times between the operator and the load on the pallet.

22. A guard for the operator of a vehicle having load elevating tines used to transport and stack on a rack in vertical columns pallets each having a load thereon, said guard comprising: a frame having a base portion and an upright screen portion integral with each other to form an L-shaped member, said pallet having a load support surface and a pair of dependent legs, one adjacent each side of the pallet, said base portion of said frame being of a width to be seated between and closely adjacent said pallet legs, upstanding inverted U-shaped members on said base portion of said frame through which the tines of the vehicle can pass as the tines are moved into position for lifting said frame and the pallet with said screen portion between the operator and the load on the pallet; said means supporting said frame independently of said pallet while the pallet is being raised or lowered.

* * * * *

UNITED STATES PATENT AND TRADEMARK OFFICE

CERTIFICATE OF CORRECTION

PATENT NO. : 5,220,980
DATED : Jun. 22, 1993
INVENTOR(S) : Jay C. Petter

It is certified that error appears in the above-indentified patent and that said Letters Patent is hereby corrected as shown below:

Column 2, line 48
"21 an" should be --21 and--;

Column 5, line 43
"pallet leg" should be --pallet legs--;

Column 8, line 20, Claim 18
After "racks" insert --as--;

Column 8, line 48, Claim 21
"column" should be --columns--;

Signed and Sealed this

Tenth Day of May, 1994

Bruce Lehman

*Attest:*

BRUCE LEHMAN

*Attesting Officer*

*Commissioner of Patents and Trademarks*